US008771096B2

(12) United States Patent
Cameron

(10) Patent No.: US 8,771,096 B2
(45) **Date of Patent: *Jul. 8, 2014**

(54) GOLF CLUB WITH MULTI-COMPONENT NECK

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 8 days.

This patent is subject to a terminal disclaimer.

(21) Appl. No.: 13/568,241

(22) Filed: Aug. 7, 2012

(65) Prior Publication Data

US 2013/0005499 A1 Jan. 3, 2013

Related U.S. Application Data

(63) Continuation-in-part of application No. 10/946,394, filed on Sep. 22, 2004.

(51) Int. Cl.

| | |
|---|---|
| ***A63B 69/36*** | (2006.01) |
| ***A63B 53/02*** | (2006.01) |
| ***A63B 53/06*** | (2006.01) |

(52) U.S. Cl.

USPC ..... 473/244; 473/245; 473/246; 473/248; 473/251; 473/305; 473/313; 473/314; 473/324; 473/409

(58) Field of Classification Search

USPC ..... 473/324–350, 287–292, 251–256, 473/305–315, 409; D21/736–746

See application file for complete search history.

(56) References Cited

U.S. PATENT DOCUMENTS

| | | | | |
|---|---|---|---|---|
| 1,983,158 | A | 12/1934 | Young | 473/310 |
| 2,067,556 | A | 1/1937 | Wettlaufer | 473/308 |
| 2,820,638 | A | 1/1958 | Morrison | 473/252 |
| 3,191,936 | A | 6/1965 | Guier | 473/313 |
| 3,341,203 | A | 9/1967 | Brill | 473/298 |
| 3,397,888 | A | 8/1968 | Springer et al. | 473/248 |
| 3,909,005 | A | 9/1975 | Piszel | 473/248 |
| 3,980,301 | A | 9/1976 | Smith | 473/314 |
| 4,231,576 | A | 11/1980 | Perkins | 473/242 |
| 4,736,951 | A | 4/1988 | Grant | 473/246 |
| 4,815,739 | A | 3/1989 | Donica | 473/313 |

(Continued)

FOREIGN PATENT DOCUMENTS

JP 8-224324 9/1996

OTHER PUBLICATIONS

Non-Final Office Action dated Jun. 27, 2006 of corresponding U.S. Appl. No. 10/946,394.

(Continued)

*Primary Examiner* — Sebastiano Passaniti

(74) *Attorney, Agent, or Firm* — Smith, Gambrell & Russell, LLP

(57) ABSTRACT

A golf putter with a multi-component neck providing a novel offset and shaft-attachment design is described and claimed. The club includes a head having a strike surface, a sole, and a top line. The multi-component neck includes a lower neck component and a coupling member. The coupling member is joined to a shaft. The coupling member connects the lower neck component and the shaft such that they are relatively offset. The length of the lower neck component and/or the design of the coupling member determine the distance from the club head center of gravity and the intersection of the projected longitudinal axis of the shaft with the head.

14 Claims, 8 Drawing Sheets

(56) References Cited

U.S. PATENT DOCUMENTS

| | | | | |
|---|---|---|---|---|
| 4,852,879 | A | 8/1989 | Collins | 473/251 |
| 4,909,515 | A | 3/1990 | Redkey | 473/236 |
| 4,915,385 | A | 4/1990 | Anderson | 473/249 |
| 4,951,949 | A | 8/1990 | Kastenhuber | 473/313 |
| 5,137,275 | A | 8/1992 | Nelson | 473/306 |
| 5,255,914 | A | 10/1993 | Schroder | 473/309 |
| 5,292,128 | A | 3/1994 | Solheim | 472/313 |
| 5,308,068 | A | 5/1994 | Strand | 273/164.1 |
| 5,470,063 | A | 11/1995 | Fisher | 473/248 |
| 5,492,329 | A | 2/1996 | Kronin | 473/220 |
| 5,494,288 | A | 2/1996 | Jimenez et al. | 473/313 |
| 5,542,666 | A | 8/1996 | Chou | 473/314 |
| 5,544,883 | A | 8/1996 | Meyer | 473/313 |
| 5,564,990 | A | 10/1996 | Weeks | 473/251 |
| 5,616,087 | A | 4/1997 | Bothwell | 473/316 |
| 5,626,528 | A | 5/1997 | Toulon | 473/248 |
| 5,658,207 | A | 8/1997 | Aizawa et al. | 473/345 |
| 5,803,824 | A | 9/1998 | Rollingson | 473/246 |
| 5,839,973 | A | 11/1998 | Jackson | 473/305 |
| D404,450 | S | 1/1999 | Weeks | D21/743 |
| 5,857,922 | A | 1/1999 | Delio | 473/313 |
| 5,885,170 | A | 3/1999 | Takeda | 473/306 |
| 5,935,016 | A | 8/1999 | Antonious | 473/305 |
| 6,095,929 | A | 8/2000 | Clark | 473/248 |
| D434,094 | S | 11/2000 | Miyashita | D21/744 |
| 6,213,889 | B1 | 4/2001 | Hamburger | 473/245 |
| 6,234,915 | B1 | 5/2001 | Wu | 473/248 |
| 6,287,215 | B1 | 9/2001 | Fisher | 473/309 |
| 6,471,599 | B2 | 10/2002 | Ford | 473/242 |
| 6,663,496 | B2 * | 12/2003 | Cameron et al. | 473/220 |
| 7,789,766 | B2 | 9/2010 | Morris et al. | 473/246 |
| 7,862,443 | B2 * | 1/2011 | Cameron | 473/244 |
| 8,172,695 | B2 * | 5/2012 | Cameron | 473/244 |
| 2003/0207724 | A1 | 11/2003 | Cameron et al. | |
| 2004/0102254 | A1 | 5/2004 | Mills | 473/244 |
| 2006/0063601 | A1 * | 3/2006 | Cameron | 473/252 |
| 2010/0062870 | A1 | 3/2010 | Pouliot et al. | 473/251 |

OTHER PUBLICATIONS

Non-Final Office Action dated Dec. 15, 2006 of corresponding U.S. Appl. No. 10/946,394.

Final Office Action dated Jun. 5, 2007 of corresponding U.S. Appl. No. 10/946,394.

Advisory Action dated Nov. 2, 2007 of corresponding U.S. Appl. No. 10/946,394.

Non-Final Office Action dated Dec. 24, 2008 of corresponding U.S. Appl. No. 11/503,125.

Non-Final Office Action dated Oct. 14, 2009 of corresponding U.S. Appl. No. 11/503,125.

Final Office Action dated Apr. 12, 2010 of corresponding U.S. Appl. No. 11/503,125.

Notice of Allowance dated Aug. 30, 2010 of corresponding U.S. Appl. No. 11/503,125.

Non-Final Office Action dated Dec. 8, 2010 of corresponding U.S. Appl. No. 12/890,093.

Non-Final Office Action dated Aug. 12, 2011 of corresponding U.S. Appl. No. 12/890,093.

Notice of Allowance dated Jan. 23, 2012 of corresponding U.S. Appl. No. 12/890,093.

Notice of Allowance dated Aug. 30, 2013 of corresponding U.S. Appl. No. 10/946,394.

* cited by examiner

GOLF CLUB WITH MULTI-COMPONENT NECK

CROSS-REFERENCE TO RELATED APPLICATIONS

This application is a continuation-in-part of U.S. patent application Ser. No. 10/946,394, filed Sep. 22, 2004, now pending, the entire disclosure of which is incorporated by reference herein.

FIELD OF THE INVENTION

The present invention relates to a golf club, and, more particularly, the present invention relates to a golf putter with a multi-component neck that provides a novel offset and shaft-attachment design.

BACKGROUND OF THE INVENTION

While not every putter has a hosel, for those putters designed with a hosel, there are different combinations of shape, length, and location depending on what the manufacturer wants to achieve in the balance and dynamic performance of the putter. For example, an offset shaft that is forward of the hosel may help the golfer achieve a desired putting posture of having the hands forward of the club head. Known offset golf putters initially extend substantially vertically away from the club head (such as via a hosel or neck) and then transition into an offset, shaft that is angled heel-ward relative the club head.

Typically, putter hosels or necks are formed integrally with the club head. Accordingly, the hosel or neck is generally formed from the same material as the club head, e.g., steel, and is solid. As a result, the hosel or neck provides unnecessary mass placed high and heel-ward relative the club head.

Moreover, because the relationship between the shaft axis and the center of gravity of the club head in such designs is fixed, the only way to alter the relationship is through bending the hosel/neck. However, bending presents difficulties due to material limitations.

It would be advantageous to maximize the mass distribution of the putter by minimizing the mass allocated by the hosel or neck. In addition, there remains a need in the art to alter the relationship between the shaft axis and the center of gravity that does not require bending.

SUMMARY OF THE INVENTION

The present invention relates to a golf putter with a novel offset and shaft-attachment design. The club includes a head having a strike surface, a sole, and a top line. A tube is coupled to the head, preferably along the top line, and extends away from the head. A coupling member is coupled to the distal end of the tube. A shaft is also coupled to the coupling member.

The coupling member connects the tube and the shaft such that they are relatively offset. A preferred amount of offset is from about 0.1 inch to 1 inch. The tube is coupled to the head at an angle from about 2° to 45°, and preferably the shaft is coupled such that its longitudinal axis is parallel to the tube longitudinal axis. The tube preferably has a length between about 1 inch and 4 inches, and the travel distance from a junction between the shaft and the coupling member to the sole preferably is 5 inches or less. The coupling member may be provided with female projections into which the tube and the shaft are coupled. Alternatively, the coupling member may be provided with male connections over which the tube and the shaft are coupled.

The tube may be coupled to the club head at any desirable location. A preferred location is along the top line. If the tube is coupled to the top line, it preferably is coupled within a middle third or a heel-end third of the top line length. The tube has a relatively low specific gravity compared to the club head to provide a desirable moment of inertia. Preferably, the tube is a lower section of a steel or graphite shaft.

As an instrument for helping the golfer properly align the club during use, the club head has alignment indicia thereon. The indicia may be provided in any form, with a plurality of dots being preferred. In a preferred embodiment, the indicia is provided on the heel side of the head, adjacent the tube. Since the tube is coupled to the head at an angle, the tube blocks the indicia from a user's view at address when the head is aligned properly. If the club head is not properly aligned at address, the golfer will be able to see the alignment indicia and, therefore, know to adjust the club to square it with the intended putting path. Thus, there is a negative reinforcement of alignment or, in other words, the indicia is not visible when the club head is properly aligned, but is visible when improperly aligned.

The present invention also relates to a golf club, including: a head; a lower neck component including a first neck end and a second neck end and having a mass from about 5 g to about 15 g, wherein the first neck end is coupled to the head, wherein the lower neck component has a first longitudinal axis and a first length, and wherein the lower neck component is formed from a first material having a first specific gravity; a coupling member including a first member end and a second member end, wherein the first member end is coupled to the lower neck component, wherein the coupling member has a mass of about 5 g to about 15, and wherein the coupling member is formed form a second material having a second specific gravity less than the first specific gravity; and a shaft coupled to the second member end, wherein the shaft has a second longitudinal axis substantially not parallel to the first longitudinal axis, wherein the shaft is offset from the head, and wherein the coupling member provides the offset.

In one embodiment, the second material has a specific gravity of about 2 to about 3 g/cm$^3$. In another embodiment, the head is formed from a third material. In yet another embodiment, the third material has a third specific gravity, and wherein the first specific gravity and third specific gravity vary by less than about 20 percent.

In this aspect of the invention, the head may have a center of gravity such that a projection of the second longitudinal axis onto the strike face of the head is at a distance A from the center of gravity. In one embodiment, the distance A is dependent on the first length.

The present invention also relates to a golf club including a head having a strike face, a multi-component neck, and a shaft, wherein the multi-component neck includes a lower neck component and a coupling member, wherein the coupling member has a first end and a second end and wherein the first end is coupled to the lower neck component and the second end is coupled to the shaft, wherein the coupling member is formed from a first material having a first specific gravity, the lower neck component and the shaft are formed from second material having a second specific gravity, and the head is formed from a third material having a third specific gravity, wherein the first specific gravity is at least 50 percent less than the second specific gravity, and wherein the second and third specific gravities vary from each other by less than about 20 percent, and wherein the lower neck component has a first longitudinal axis and the shaft has a second longitudinal axis that differs from the first longitudinal axis.

In one embodiment, the lower neck component has a length L, and wherein the second longitudinal axis creates a lie angle that remains constant regardless of the length L. In another embodiment, the head has a center of gravity CG, and wherein a projection of the second longitudinal axis intersects the strike face at distance A from the CG. In still another embodiment, the distance A is dependent on the length L.

The second and third specific gravities may be the same or different. In one embodiment, the first specific gravity ranges from about 2 to about 3 g/cm$^3$, and wherein the second and third specific gravities range from about 7 to about 8 g/cm$^3$.

The present invention is also directed to a method of forming a golf club including the steps of: providing a golf club head having a center of gravity and formed at least in part from a material having a first specific gravity; providing a shaft formed from a second material having a second specific gravity, wherein the second specific gravity differs from the first specific gravity by less than about 10 percent; dividing the shaft into a lower neck component and an upper shaft, wherein the upper shaft has a lower end and an upper end, wherein the lower neck component has a first neck end and a second neck end and a first length, wherein the first neck end is coupled to the golf club head; providing a coupling member including a first coupling member end and a second coupling member end, wherein the first coupling member end is coupled to the second neck end and the second coupling member end is coupled to the lower end of the upper shaft, wherein the lower neck component has a first longitudinal axis and the upper shaft has a second longitudinal axis that differs from the first longitudinal axis, and wherein the coupling member is formed of a third material having a third specific gravity less than the first and second specific gravities.

In this aspect of the invention, the step of dividing the shaft may include determining the first length based on a predetermined distance from the center of gravity and the intersection of a projection of the second longitudinal axis with a strike face of the golf club head.

BRIEF DESCRIPTION OF THE DRAWINGS

Further features and advantages of the invention can be ascertained from the following detailed description that is provided in connection with the drawings described below:

FIG. 6 is a schematic diagram showing the steps for making a golf club in accordance with an embodiment of the present invention.

DETAILED DESCRIPTION OF THE INVENTION

Figure 1:
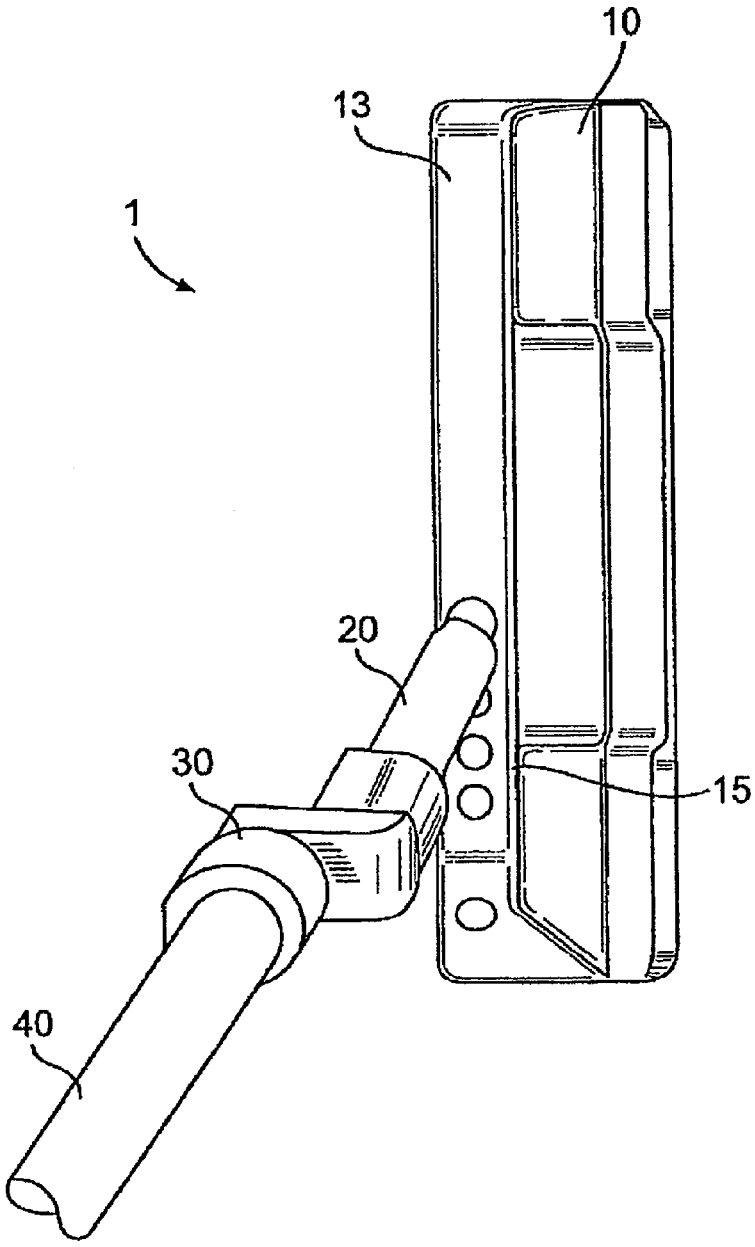
FIG. 1 shows a top view of a golf club according to a first embodiment of the present invention.
Figure 2:
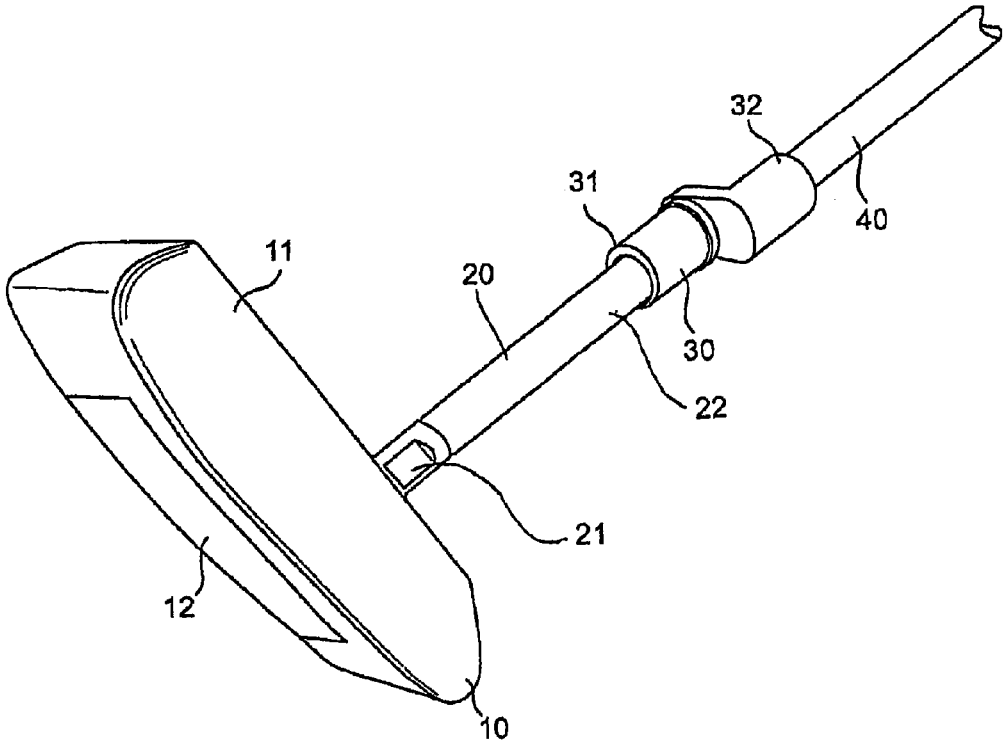
FIG. 2 shows a front view of the golf club of FIG. 1.

FIG. 1 shows a top view an embodiment of a golf club 1 of the present invention, and FIG. 2 shows a front view of the golf club 1. The golf club 1 includes a head 10 having a strike face 11, a sole 12, and a top line 13. A tube 20 is coupled to the head 10, either directly thereto or via a hosel. This hosel may be male, such that it is not seen in the assembled product. A first end 21 of the tube 20 is coupled to the head 10, with the tube 20 extending away from the head 10. A first end 31 of a coupling member 30 is coupled to the tube 20 at a tube second end 22. A shaft 40 is coupled to a second end 32 of the coupling member 30. (Only a portion of the shaft 40 is shown in the figures.) These parts are assembled in known fashion, such as by welding and/or through the use of an adhesive.

Inertia is a property of matter by which a body remains at rest or in uniform motion unless acted upon by some external force. Moment of inertia (MOI) is a measure of the resistance of a body to angular acceleration about a given axis, and is equal to the sum of the products of each element of mass in the body and the square of the element's distance from the axis. Thus, as the distance from the axis increases, the MOI increases. As the MOI increases, the stability and playability of the club head increases. The club head 10 preferably is contoured and weighted to produce desirable MOI and acoustic characteristics during use.

In this aspect of the invention, the tube 20 has a specific gravity less than that of the head 10, preferably substantially less. In a preferred embodiment, the tube 20 is a lower portion of a shaft, such as the shaft 40. Use of a lightweight tube 20 beneficially removes, to a large degree, the influence the hosels of typical golf clubs have on those clubs' MOI. The result is a more balanced and playable golf club. This is particularly important with golf putting shots, for which the acceptable margin of error is particularly small. In one embodiment, the tube 20 is a hollow, steel tubular structure with a low average specific gravity and a mass of about 3 to 5 grams. The tube 20 may also be filled with a loading material. In one embodiment, the loading material is a foamed material. The size of the coupling member 30 is controlled to further enhance the club head MOI, and preferably the coupling member 30 has a mass of 5 to 15 grams.

During a proper putting stroke, the golfer's hands are slightly ahead of the putter head. For this reason, putter designers commonly incorporate some amount of offset in their clubs. That is, the shaft is positioned forward (i.e., towards the strike face) from the hosel or club head. In the club 1 of the present invention, the coupling member 30 preferably provides offset between the shaft 40 and the tube 20 and/or the head 10. A preferred amount of offset is from 0.1 inch to 1 inch. In a preferred embodiment, an extension of the longitudinal axis of the shaft 40 intersects the strike face 11.

Figure 1A:
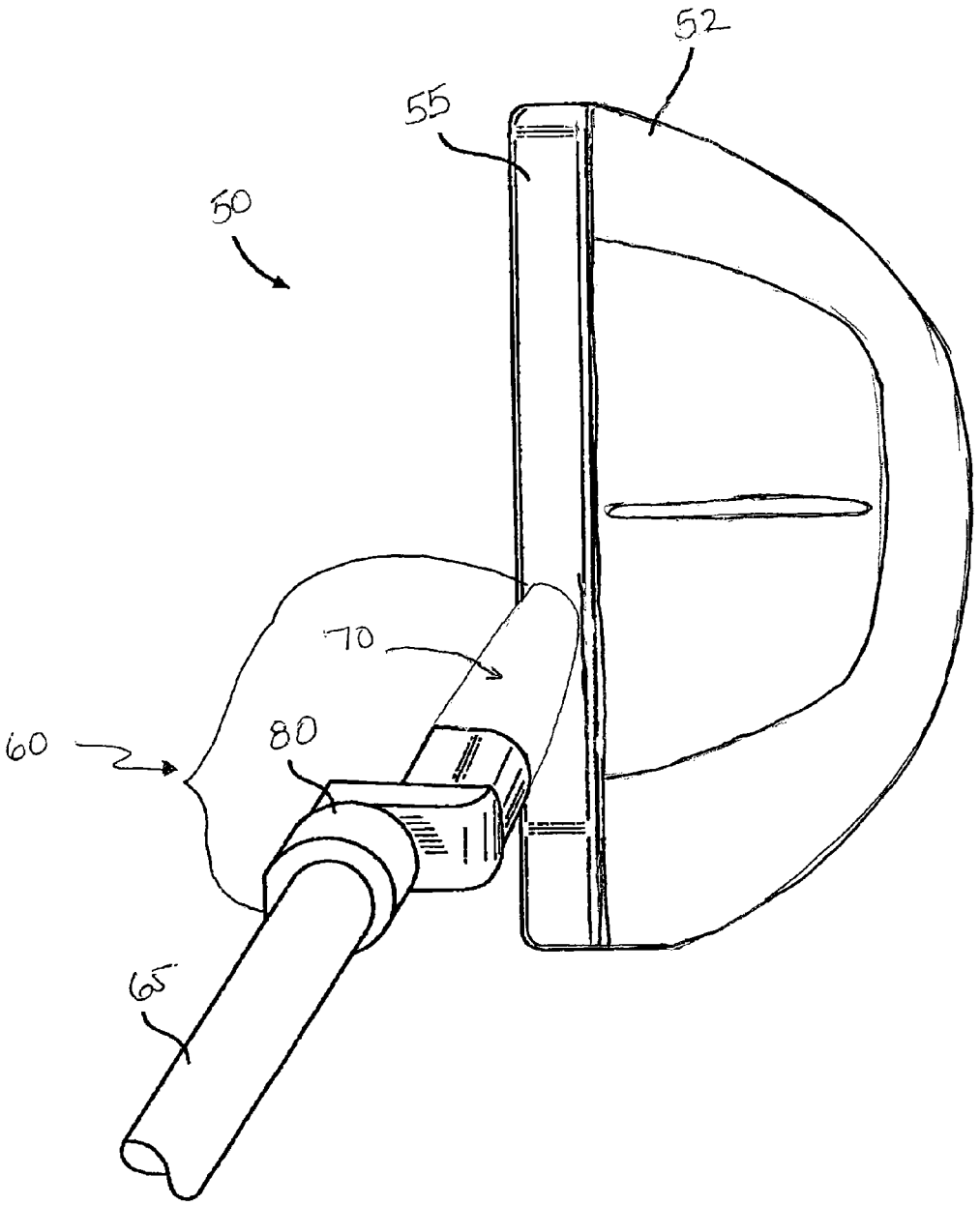
FIG. 1A shows a top view of a golf club according to a second embodiment of the present invention.
Figure 2A:
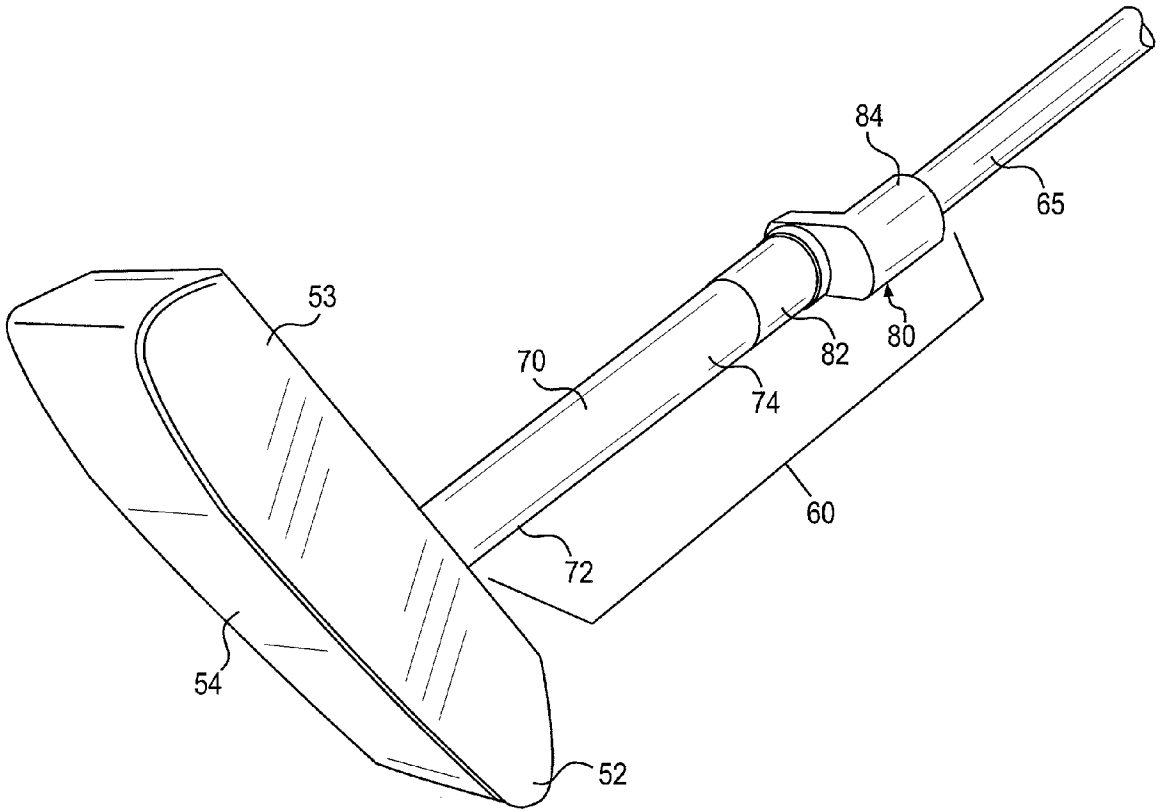
FIG. 2A shows a front view of the golf club of FIG. 1A.

FIG. 1A shows a top view of another embodiment of a golf club 50 according to the present invention. FIG. 2A shows a front view of the golf club 50. In this aspect of the invention, the golf club 50 includes a head 52 having a strike face 53, a sole 54, and a top line 55. A multi-component neck 60, which includes a lower neck component 70 and a coupling member 80, is coupled to the shaft 65. The neck 60 is coupled to the club head 52 via the lower neck component 70. In one embodiment, the lower neck component 70 has a first end 72 that is coupled to the club head 52 and a second end 74 that extends away from the head 52. A coupling member 80 has a first end 82, which is coupled to the lower neck component 70, and a second end 84, which is coupled to the shaft 65. The first and second ends 82, 84 of the coupling member 80 may be male and female connections, respectively or vice versa.

The amount that the lower neck component 70 extends into the club head may be varied depending on the desired design. In one embodiment, the lower neck component 70 is coupled to a bore in the club head and extends into at least about 50 percent of the club head. In another embodiment, the lower neck component 70 extends into at least about 75 percent of the club head. In yet another embodiment, the entire length of the lower neck component 70 extends through the club head 70 so that the first end 72 is accessible from the sole 54. In other words, when the lower neck component 70 extends entirely through the club head 52, the inside of the lower neck component 70 is accessible. In such a design, the sole opening may be covered by a removable sole weight or cover.

The lower neck component 70 may be formed from a variety of materials. In particular, suitable materials used to form the lower neck component are stiff and preferably lightweight. For example, in one embodiment, the lower neck component weighs about 5 to about 15 grams and is formed from a material having a specific gravity of about 5 to about 8 g/cm$^3$. One method of forming the multi-component neck 60 of the golf club 50 shown in FIGS. 1A and 2A is to provide a shaft having a length equal to or greater than the sum of the predetermined lengths of the lower neck component 70 and shaft 65 and cleave a portion therefrom to create the lower neck component 70 having a predetermined length and shaft 65 having a predetermined length. In this aspect of the invention, the lower neck component 70 and shaft 65 are formed of the same material.

The lower neck component 70 and shaft 65 may be solid or hollow. In one embodiment, the shaft 65 is hollow. In another embodiment, the lower neck component 70 is hollow. For example, the lower neck component 70 may be, but is not limited to, a tubular structure. In yet another embodiment, both the lower neck component 70 and the shaft 65 are hollow. As discussed in greater detail below, if hollow, either or both of the lower neck component 70 and shaft 65 may be loaded with a material to alter the mass distribution, vibration, sound, or combinations thereof.

In one embodiment, the lower neck component 70 and shaft 65, has a specific gravity that is substantially the same as the specific gravity of the material used to form the head. In particular, a lower neck component 70 having a substantially similar specific gravity as the head material provides a desired stiffness and also allows for the tube to be hollowed out for weight savings and potential loading. In this aspect of the invention, the specific gravity of the lower neck component 70 shown in club head of FIG. 1A may have a specific gravity that varies less than about 20 percent from the specific gravity of the head 52. In one embodiment, the specific gravity of the lower neck component 70 and the specific gravity of the head 52 vary less than about 10 percent. In another embodiment, the specific gravity of the lower neck component 70 varies less than about 5 percent from the specific gravity of the head 52.

In another embodiment, the lower neck component 70 and shaft 65 may be formed from different materials. For example, the lower neck component 70 may be formed from a material having a specific gravity substantially similar to the specific gravity of the material used to form the head and the shaft 65 may be formed of a material having a specific gravity different from the specific gravity of the material used to form the head. In an alternate embodiment, the shaft 65 may be formed from a material having a specific gravity substantially similar to the specific gravity of the material used to form the head and the lower neck component 70 may be formed of a material having a specific gravity different from the specific gravity of the material used to form the head.

For example, the lower neck component 70 may be formed of a material having a specific gravity ranging from about 4 to about 8.0 g/cm$^3$. In one embodiment, the material used to form the lower neck component 70 has a specific gravity between about 6 and 8 g/cm$^3$. In another embodiment, the lower neck component 70 is formed from a material having a specific gravity between about 6.5 and 7.9 g/cm$^3$. In still another embodiment, the material used to form lower neck component 70 has a specific gravity between about 7 and 7.8 g/cm$^3$. In yet another embodiment, the lower neck component 70 is formed from a material having a specific gravity of about 4 to about 5 g/cm$^3$.

In one embodiment, the material used to form the lower neck component 70 is a stainless steel material similar or identical to the stainless steel used to form the majority of the club head 50. In this aspect, the shaft 65 may be formed from the same or similar material as used to form the lower neck component 70 or, alternatively, the shaft 65 may be formed from a material having specific gravity less than the specific gravity of the lower neck component 70. For example, the shaft 65 may be formed from a material having a specific gravity ranging from about 2 to about 3 g/cm$^3$, e.g., graphite. In another embodiment, the lower neck component 70 and/or shaft 65 may be formed of titanium, titanium alloy, or composite alloy material and the club head may be formed of a material having a greater specific gravity such as stainless steel.

The weight of the lower neck component 70 may vary depending on the material used to form the tube. In one embodiment, the lower neck component 70 weighs between 4 g and about 16 g. In another embodiment, the tube weighs from about 5 g to about 15 g. For example, a lower neck component lower neck component 70 may range from about 8 g to about 12 g and a shorter lower neck component 70 may range from about 6 g to about 10 g. In one embodiment, the weight of the lower neck component 70 ranges from about 7 g to about 9 g. In another embodiment, the lower neck component 70 weighs between about 9 g to about 11 g.

Figures 4A, 4B:
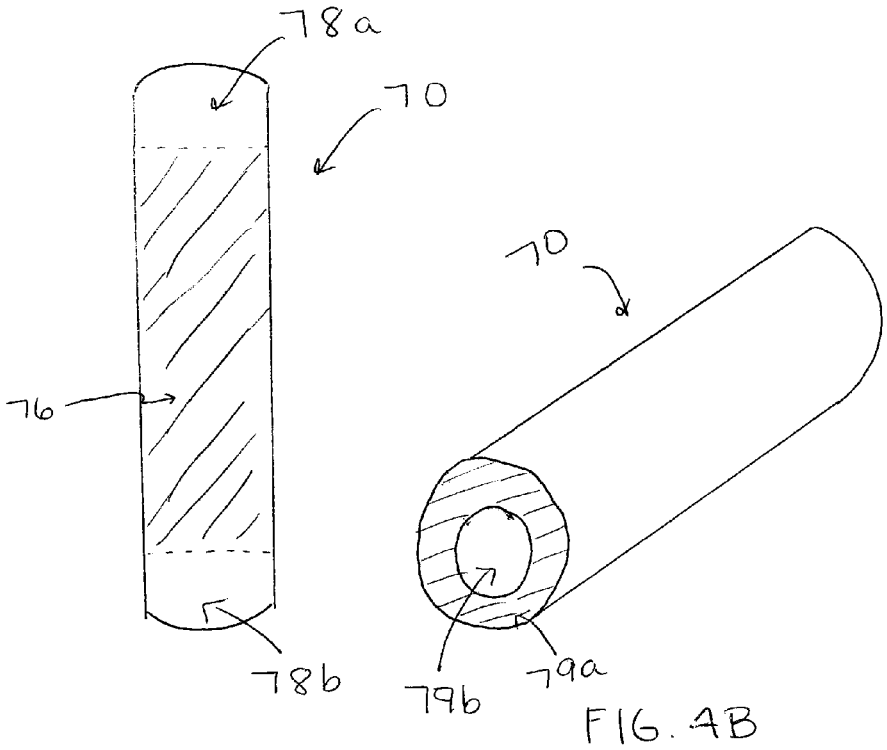
FIGS. 4A and 4B show side and sectional views of the tube, respectively, according to embodiments of the present invention.

When hollow, the lower neck component 70 may be filled with a loading material such as foam, tungsten, tungsten-loaded polymers, polyurethane, cork, lead powder, mixtures thereof, and the like. For example, in the embodiment shown in FIG. 4A, the lower neck component 70 may first be loaded with a first material 76, such as lead powder, tungsten, or the like, and a second material 78*a* and 78*b*, such as cork, may be used to hold the first material 76 in place. The second material 78*a* and 78*b* may be the same or different from each other. As shown in FIG. 4*b*, the lower neck component 70 may have a cladding or inner tube 79*a*, which differs from the loading material 79*b* that it surrounds.

An extension of the longitudinal axis of the shaft, i.e., the projected shaft axis, may intersect the strike face at a distance A from the center of gravity (CG). It is important to note that the shaft axis need not and may not interest the strike face, or any portion of the head, other than the multi-component neck and, more particularly, the coupling member 80. However, the projected of the longitudinal axis of the shaft 68 will be at a distance A from the projected location of the CG.

The present invention also relates to a method for adjusting distance A without changing the loft and lie of the head. In one embodiment, the distance A, may be from about 0.1 inches to about 1.5 inches. In another embodiment, the distance A may range from about 0.2 inches to about 1.3 inches. In yet another embodiment, the distance A may range from about 0.3 inches to about 1 inch.

Figure 3A:
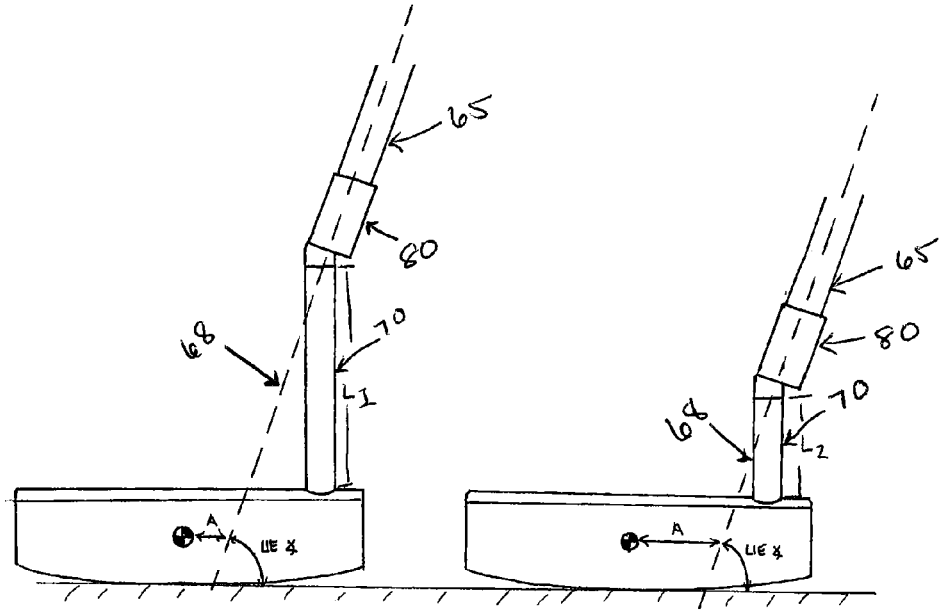
FIG. 3A shows front views of the golf club of FIG. 1A with a projected shaft axis.

Without being bound to any particular theory, adjusting the distance A provides differing face balances about the shaft axis, which provides stroke optimization capabilities for a variety of golfers. In particular, in one embodiment, the length of the lower neck component 70 may be adjusted to alter the projected shaft axis 68 relative the CG. In this aspect of the invention, the lie angle α remains constant regardless of the tube length. In particular, because the lower neck component 70 is not parallel to the shaft, the length of the lower neck component 70 may be selected to alter the projected shaft axis 68. For example, as shown in FIG. 3A, when lower neck component 70 has a length $L_1$, the distance A, which is the distance from the CG to the projected shaft axis 68, is less than the distance A when lower neck component 70 has a length $L_2$. Accordingly, the length of the lower neck component 70 may be adjusted to provide different feedback to a golfer during a putter stroke.

In this aspect of the invention, the present invention contemplates a kit of multi-component necks 60. In one embodiment, the lower neck components 70 in the kit may have varying lengths, which allow for selection of the lower neck component 70 depending on the desired distance A. In one embodiment, the kit includes a plurality of lower neck components 70 having lengths ranging from about 0.1 to about 1.5 inches. In another embodiment, the kit includes at least two lower neck components 70, each lower neck component having a length at least 5 percent different than the other lower neck components. For example, a kit of lower neck components may include a first lower neck component having a first length, a second lower neck component having a second lower neck component having a second length, and a third lower neck component having a third length. The first length may be less than the second length and the second length may be more than the third length.

Figure 3B:
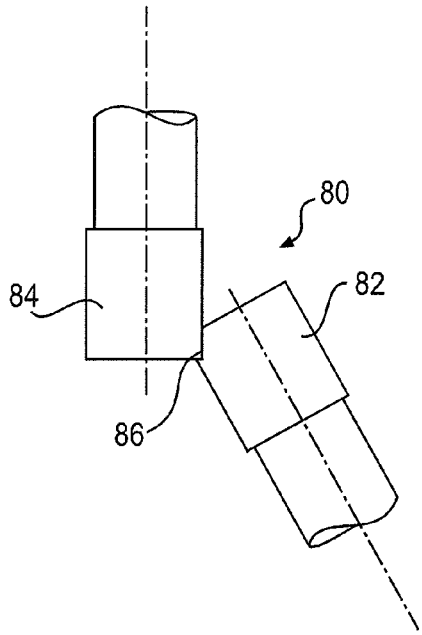
FIGS. 3B and 3C shows front and orthogonal views of one embodiment of the coupling member.

In an alternate embodiment, the coupling member 80 may be selected to adjust the distance A. In particular, the coupling member 80, which may be formed from a variety of materials and with a variety of configurations, may be adjusted to alter the distance A while lower neck component 70 has a constant length. Indeed, as shown in FIG. 3B, the coupling member 80 may be malleable, thus allowing the relative positions of the shaft 65 to be varied. In this manner, the distance A may be adjusted to suit an individual golfer's putter stroke. As with the previous embodiment, the lower neck component 70 and shaft 65 are not parallel and the coupling member 80 allows customization without requiring shaft bending. While the coupling member 80 is malleable in this embodiment, it is preferably malleable only to the extent necessary to adjust the distance A and not to an extent that it can be adjusted during normal use of the club.

In this aspect, the present invention also contemplates a kit of non-malleable coupling members 80 having various configurations, which can be selected based on the desired distance A. In one embodiment, the kit includes a plurality of coupling members 80, each of which provides a unique distance A, i.e., a distance A that differs for each coupling member. For example, the kit may include at least two coupling members, each providing a unique distance A. In another embodiment, the kit includes at least three coupling members 80, each providing a unique distance A.

Figure 3C:
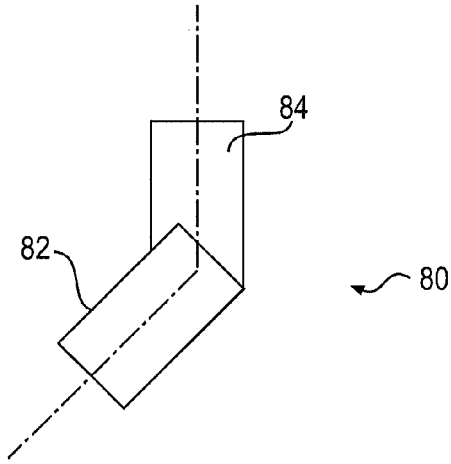

In the illustrated embodiment of FIGS. 3B and 3C, the coupling member 80 includes a lower tubular section 82 and an upper tubular section 84. The lower neck component 70 is coupled to the coupling member lower section 82, and the shaft 65 is coupled to the upper section 84. It should be noted, however, that the adjustability benefits can also be used with other forms of the coupling member 80, such as the embodiment illustrated in FIG. 5 (described in more detail below). A connection 86 joins the coupling member portions 82, 84. The connection 86 may take a variety of forms, one preferred form being simply an area of weakened or thinned-out material. For example, one or more holes may be provided in the connection 86 to weaken it or material may be removed from the edges of the connection 86. Of course, the connection 86 is robust enough to withstand the stresses and strains imposed upon it through normal use of the golf club, at an acceptable factor of safety, without deformation. The lower and upper portions 82, 84 can be formed together, or may be formed separately and then joined together in known fashion.

Longitudinal axes for the lower and upper coupling member sections 82, 84 are shown in FIG. 3B for illustrative purposes. While a comparatively large degree of relative angulation between the lower and upper sections 82, 84 are shown, virtually any amount of angulation may be obtained. Furthermore, while the lower and upper sections 82, 84 are shown as being offset in the illustrated embodiment, they need not be. That is, the lower and upper sections 82, 84 may be oriented such that they share a common longitudinal axis prior to bending. This allows for customization without offset while using a shaft formed from graphite or other non-bendable material.

The coupling member 30/80 may be formed from a variety of materials including, but not limited to aluminum, aluminum alloy, stainless steels, and mixtures thereof. In one embodiment, the specific gravity of the material used to form the coupling member ranges from about 2 to about 3.5 g/cm$^3$. In another embodiment, the specific gravity of the material used to form the coupling member ranges from about 2.4 to about 3 g/cm$^3$. In still another embodiment, the material used to form the coupling member ranges from about 2.5 to about 2.8 g/cm$^3$.

The ratio of the specific gravity of the lower neck component 70 to the specific gravity of the coupling member may be about 2 to about 3. In one embodiment, the ratio of the specific gravities of the materials used to form the lower neck component 70 and coupling member 80 is from about 2.0 to about 2.4.

The weight may vary depending on the material used to form the coupling member 80. In one embodiment, the coupling member 80 weighs between about 5 g and 15 g. In another embodiment, the coupling member has a mass of about 7 to about 12 g. In still another embodiment, the coupling member has a mass of about 8 g to about 10 g.

Figure 5:
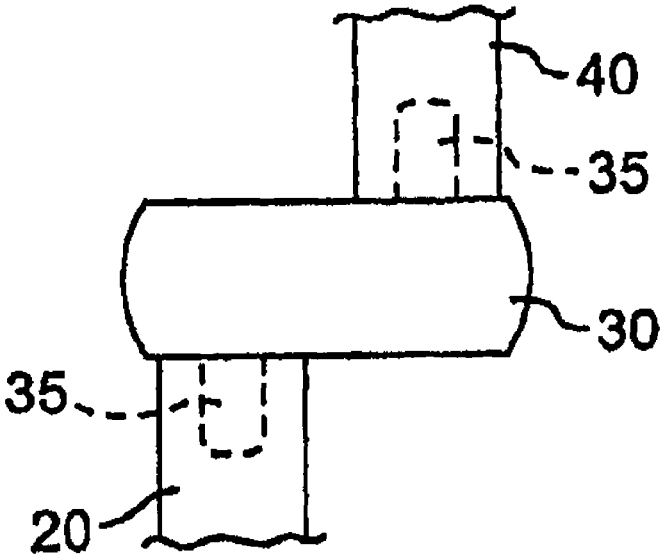
FIG. 5 shows an alternate embodiment of the coupling member of the golf club of FIGS. 1, 1A, 2, and 2A.

The United States Golf Association (USGA) and the Royal and Ancient Golf Club of St. Andrews (R&A), the governing bodies of golf, have instituted rules defining "legal" golf clubs. It is important that clubs not violate these rules. Both of these governing bodies require that the shaft must be attached to the club head, either directly or through a single plain neck and/or socket, such that the length from the top of the neck and/or socket to the sole of the club must not exceed 5 inches, measured along the axis of, and following any bend in, the neck and/or socket. Thus, the travel distance from the bottom of the sole 12, along the tube 20 and coupling member 30, to the bottom of the shaft 40 where it is coupled to the coupling member second end 32 is 5 inches or less. To help achieve this requirement, the coupling member 30 may be provided with projections 35 over which the tube 20/lower neck component 70 and the shaft 40/shaft 65 are coupled. This embodiment of the coupling member 30/80 is shown in FIG. 5. The projections 35 are illustrated with dotted lines because they are not visible in the assembled golf club. This embodiment is distinguished from the embodiment shown in FIGS. 1, 1A, 2, and 2A, which includes projections into which the tube 20/lower neck component 70 and the shaft 40/shaft 65 are coupled. In this aspect of the invention, the tube 20/lower neck component 70 preferably has a length as measured from a junction with the head 10 to a junction with the coupling member 30 between about 1 inch and 4 inches.

In one embodiment, the strike face 11 has a loft angle (the angle of the face 11 relative a vertical plane passing through the leading edge of the club head 10) of 10° or less, and the sole 12 has a draft angle (the angle of the sole 12 relative a horizontal plane passing through the trailing edge of the club head 10) of 10° or less. Preferably, the loft angle and the draft angle are chosen such that the strike face 11 is substantially square when the club 1 is rested on the sole 12 at address. This beneficially facilitates closing the club head 1 during a golf swing. More preferably, the 10 ft angle is from 2° to 6° and the draft angle is 5° or less.

The top line 13 has a length that may be described in thirds: a heel third, a middle third, and a toe third. The tube 20/lower neck component 70 preferably may be coupled to the club head 10 along the top line 13. While the tube 20/lower neck component 70 may be coupled to the top line 13 along any portion thereof, coupling in the heel or middle thirds of the top line 13 is preferred.

It is important that a golfer strike the ball squarely. This is particularly important with putting shots, due to the small margin of error associated with these shots. As an instrument for helping the golfer properly align the club 1, the club head 10 includes an alignment indicia 15 thereon. The indicia 15 may be provided in a variety of forms, a plurality of dots being preferred. The indicia 15 may be an integral part of the head 10, or it may be affixed thereto. In a preferred embodiment, the indicia 15 is provided on the heel side of the head 10, adjacent the tube 20. The tube 20 is coupled to the head 10 at an angle, such that the tube 20 blocks the indicia from a user's view at address when the head 10 is aligned properly. Blocking an alignment indicia from the golfer's view while putting is beneficial because it eliminates a source of distraction to the golfer. In such a "mental" sport as golf, eliminating distractions can provide great benefits to the golfer. A golfer's eye will naturally be drawn to a club head alignment means, so the indicia 15 of the present invention is not viewable to the properly aligned golfer, allowing the golfer to focus on the golf ball. If the head 10 is not properly aligned at address, the golfer will be able to see the indicia 15 and, therefore, know to adjust the club 1 to square it with the intended putting path. The golfer will also know in what manner to adjust the club 1 to square it. In the case of a right-handed golfer, seeing the indicia 15 to the right of the tube 20 indicates that the golfer should open the club 1, or rotate it clockwise. Seeing the indicia 15 to the left of the tube 20 indicates that the golfer should close the club 1, or rotate it counterclockwise.

Since the ball is positioned under the golfer's left eye or just off the golfer's left foot (for a right-handed golfer) in a preferred putting position, the indicia 15 may be positioned between the strike face 11 and a vertical plane passing through a heel and a toe of the head and including the intersection of the longitudinal axis of the tube 20 and the head 10. That is, the indicia 15 may be biased toward the face 11 so that it is not visible by the golfer's right eye under preferred putting conditions. The tube 20 may be coupled to the head 10 at an angle from vertical from about 2° to 45° as projected onto a vertical plane passing through a heel and a toe of the head, with about 10° to 30° being preferred. The shaft 40 may be coupled such that it is angled relative the head 10 within the same range. Preferably, the tube 20 and the shaft 40 are coupled such that their respective longitudinal axes are substantially parallel. This results in a clean look to the putter 1, and allows the benefits of using the alignment indicia 15 as discussed above. Coupling the tube 20 at an angle relative to the head 10 simultaneously allows the golfer the dual benefit of having both an offset club and an alignment aide. While this aspect of the invention is described in reference to the club head shown in FIGS. 1 and 2, the alignment indicia may be used on any of the club heads described herein including, but not limited to, the club heads shown in FIGS. 1A and 2A.

FIG. 6 illustrates the steps for making a golf club in accordance with the present invention.

Finishing touches, e.g., painting and sanding, may optionally be performed on any of the golf club components described herein for aesthetic purposes.

Although the present invention has been described with reference to particular embodiments, it will be understood to those skilled in the art that the invention is capable of a variety of alternative embodiments within the spirit of the appended claims. For example, golf club heads in accordance with examples of this invention may include still additional features, if desired, including features that are known and used in the art. For example, a golf club head according to the invention may include a weighting system that is permanently mounted to the club head body member, e.g., on an interior or exterior of the club head body, extending from the exterior to the interior of the club head body (e.g., through a weight port), etc., or, in the alternative, a weighting system that includes weight member(s) that are movably and/or removably mounted with respect to the club head body member using structures and techniques that are known and used in the art (e.g., by screw or other mechanical connector attachments, by sliding attachments, etc.). Alternately, the sole may include one or more cavities that are capable of accommodating inserts having variable weights. In addition, golf clubs according to the invention may include one or more of: (a) a shaft member engaged with the club head body; (b) a grip member engaged with the shaft, and/or (c) a handle member engaged with the club head and/or the shaft. These additional elements of the golf club structure may be included in the overall club structure in any desired manner without departing from this invention, including in conventional manners that are known and used in the art (e.g., the shaft may be engaged with the club head body member via an external hosel member, via an internal hosel member, through an opening provided in the club head, via adhesives, and/or via mechanical connectors.

The invention claimed is:

1. A golf club, comprising:

a head;

a lower neck component comprising a first neck end and a second neck end and having a mass from about 5 g to about 15 g, wherein the first neck end is coupled to the head, wherein the lower neck component has a first longitudinal axis and a first length, and wherein the lower neck component is formed from a first material having a first specific gravity;

a coupling member comprising a first member end and a second member end, wherein the first member end is coupled to the lower neck component, wherein the coupling member has a mass of about 5 g to about 15 g, and wherein the coupling member is formed from a second material having a second specific gravity less than the first specific gravity; and a shaft coupled to the second member end, wherein the shaft has a second longitudinal axis substantially not parallel to the first longitudinal axis, wherein the shaft is offset from the head, and wherein the coupling member provides the offset.

2. The golf club of claim 1, wherein the second material has a specific gravity of about 2 to about 3 g/cm$^3$.

3. The golf club of claim 1, wherein the head is formed from a third material.

4. The golf club of claim 3, wherein the third material has a third specific gravity, and wherein the first specific gravity and third specific gravity vary by less than about 20 percent.

5. The golf club of claim 1, wherein the head has a center of gravity and wherein a projection of the second longitudinal axis intersects a strike face of the head at a distance A from the center of gravity.

6. The golf club of claim 5, wherein the distance A is dependent on the first length.

7. A golf club comprising:

a head having a strike face;

a multi-component neck; and a shaft, wherein the multi-component neck comprises a lower neck component and a coupling member, wherein the coupling member has a first end and a second end and wherein the first end is coupled to the lower neck component and the second end is coupled to the shaft, wherein the coupling member is formed from a first material having a first specific gravity, the lower neck component and the shaft are formed from second material having a second specific gravity, and the head is formed from a third material having a third specific gravity, wherein the first specific gravity is at least 50 percent less than the second specific gravity, and wherein the second and third specific gravities vary from each other by less than about 20 percent, and wherein the lower neck component has a first longitudinal axis and the shaft has a second longitudinal axis that differs from the first longitudinal axis.

8. The golf club of claim 7, wherein the lower neck component has a length L, and wherein the second longitudinal axis creates a lie angle that remains constant regardless of the length L.

9. The golf club of claim 8, wherein the head has a center of gravity CG, and wherein a projection of the second longitudinal axis intersects the strike face at distance A from the CG.

10. The golf club of claim 9, wherein the distance A is dependent on the length L.

11. The golf club of claim 7, wherein the second and third specific gravities are the same.

12. The golf club of claim 11, wherein the first specific gravity ranges from about 2 to about 3 g/cm$^3$, and wherein the second and third specific gravities range from about 7 to about 8 g/cm$^3$.

13. A method of forming a golf club comprising the steps of:

providing a golf club head having a center of gravity and formed at least in part from a material having a first specific gravity;

providing a shaft formed from a second material having a second specific gravity, wherein the second specific gravity differs from the first specific gravity by less than about 10 percent;

dividing the shaft into a lower neck component and an upper shaft, wherein the upper shaft has a lower end and an upper end, wherein the lower neck component has a first neck end and a second neck end and a first length, wherein the first neck end is coupled to the golf club head;

providing a coupling member comprising a first coupling member end and a second coupling member end, wherein the first coupling member end is coupled to the second neck end and the second coupling member end is coupled to the lower end of the upper shaft, wherein the lower neck component has a first longitudinal axis and the upper shaft has a second longitudinal axis that differs from the first longitudinal axis, and wherein the coupling member is formed of a third material having a third specific gravity less than the first and second specific gravities.

14. The method of claim 13, wherein the step of dividing the shaft comprises determining the first length based on a predetermined distance from the center of gravity and the intersection of a projection of the second longitudinal axis with a strike face of the golf club head.

* * * * *